US008314677B1

(12) United States Patent
Kuo

(10) Patent No.: US 8,314,677 B1
(45) Date of Patent: Nov. 20, 2012

(54) OVERCURRENT PROTECTIVE WIRE WOUND RESISTOR

(75) Inventor: Samuel Kuo, Taoyuan County (TW)

(73) Assignee: Ty-Ohm Electronic Works Co., Ltd., Taoyuan County (TW)

( * ) Notice: Subject to any disclaimer, the term of this patent is extended or adjusted under 35 U.S.C. 154(b) by 0 days.

(21) Appl. No.: 13/300,864

(22) Filed: Nov. 21, 2011

(51) Int. Cl.
*H01C 1/14* (2006.01)

(52) U.S. Cl. ..... 338/332; 338/333; 338/296; 338/264; 361/104; 361/124

(58) Field of Classification Search ..... 338/322, 338/333, 296, 259, 264
See application file for complete search history.

(56) References Cited

U.S. PATENT DOCUMENTS 3,134,087 A * 5/1964 Haynman ..... 338/332
3,283,285 A * 11/1966 Zuk ..... 338/299
4,150,355 A * 4/1979 Neff et al. ..... 338/332
4,185,263 A * 1/1980 Frey ..... 338/301
5,844,761 A * 12/1998 Place, IV ..... 361/104

* cited by examiner

*Primary Examiner* — Kyung Lee
(74) *Attorney, Agent, or Firm* — Rabin & Berdo, P.C.

(57) ABSTRACT

An overcurrent protective wire wound resistor has a core, a second contact cap and a resistance wire. A first contact cap and a resistor connection seat are respectively mounted on two ends of a rod of the core. A low melting-point conductive layer is mounted around the rod and connected with the first contact cap and the resistor connection seat. A high-temperature contractive insulation layer is mounted around the low melting-point conductive layer and the first contact cap. The second contact cap is mounted around the contractive insulation layer. The resistance wire is connected to the resistor connection seat and the second contact cap. When current through the resistance wire abnormally increases, high temperature of the resistance wire melts the low melting point conductive layer to shrink the contractive insulation layer and open the low melting-point conductive layer and the resistor, thereby protecting the circuit connected to the resistor.

20 Claims, 5 Drawing Sheets

OVERCURRENT PROTECTIVE WIRE WOUND RESISTOR

BACKGROUND OF THE INVENTION

1. Field of the Invention

The present invention relates to a resistor and more particularly to an overcurrent protective wire wound resistor.

2. Description of the Related Art

Resistors are one of the indispensable components for manufacturing all kinds of electronic products and can be generally classified as fixed resistors and variable resistors. Among the fixed resistors, resistors having resistance wires wound around are called wire wound resistors.

With reference to FIG. 5, a conventional wire wound resistor has a core 70 and a resistance wire 80. The core 70 has a rod 71 and two contact caps 72. The rod 71 has two opposite ends. The two contact caps 72 are respectively mounted on the two opposite ends of the rod 71. The resistance wire 80 is wound around a periphery of the rod 71 of the core 70. Two ends of the resistance wire 80 are electrically connected to the respective contact caps 72.

The wire wound resistor is made to have different resistance values by selecting the resistance wire 80 of choices differing in lengths and materials. The resistance wire 80 is electrically connected to external circuit components through the two contact caps 72.

However, the conventional wire wound resistor only targets at serving as a circuit component having a resistance value and connected to the external circuit components in an electronic circuit design without providing any protection to the electronic circuit. As a result, a regular electronic product usually needs a fuse to protect it against burnout arising from abnormal short circuit. Inevitably, the additional fuse increases the cost and size of the electronic product.

SUMMARY OF THE INVENTION

An objective of the present invention is to provide an overcurrent protective wire wound resistor lowering the cost and size of an electronic product connected therewith.

To achieve the foregoing objective, the overcurrent protective wire wound resistor has a high-temperature opening core, a second contact cap and a resistance wire.

The high-temperature opening core has a rod, a first contact cap and a resistor connection seat, a low melting point conductive layer and a high-temperature contractive insulation layer. The rod has two opposite ends. The first contact cap is mounted on one of the opposite ends of the rod and has two opposite ends and a first lead wire. The first lead wire is mounted on the first contact cap. The first lead wire and the rod are respectively mounted on the two opposite ends of the first contact cap. The resistor connection seat is mounted on the other of the opposite ends of the rod. The low melting point conductive layer is mounted around a periphery of the rod and extends longitudinally to the first contact cap and the resistor connection seat. The high-temperature contractive insulation layer is mounted around the low melting point conductive layer, the first contact cap and an end of the first lead wire connected with the first contact cap. A melting point of the low melting point conductive layer is lower than that of the high-temperature contractive insulation layer.

The second contact cap corresponds to the first contact cap of the high-temperature opening core and is mounted around the high-temperature contractive insulation layer so that the high-temperature contractive insulation layer is sandwiched between the second contact cap and the first contact cap and the second contact cap is electrically insulated from the first contact cap, and has a second lead wire and a through hole. The second lead wire is mounted on the second contact cap. The through hole is formed through the second contact cap to correspond to the first lead wire for the first lead wire to penetrate through the through hole.

The resistance wire is mounted around the rod to correspond to the rod and is electrically insulated from the low melting point conductive layer by the intervening high-temperature contractive insulation layer therebetween. Two ends of the resistance wire are respectively connected to the resistor connection seat and the second contact cap, and a melting point of the resistance wire is higher than that of the low melting point conductive layer.

When current flowing through the overcurrent protective wire wound resistor abnormally increases, temperature of the resistance wire rises. When the temperature of the resistance wire exceeds the melting point of the low melting point conductive layer, the low melting point conductive layer adjacent to the resistance wire melts and the high-temperature contractive insulation layer is contracted due to high temperature to push through the melted low melting point conductive layer and part of the high-temperature contractive insulation layer is attached around the rod. Accordingly, the first contact cap and the resistor connection seat fail to be electrically connected through the low melting point conductive layer, and the first lead wire and the resistance wire are electrically insulated from each other to protect circuits connected to the resistor.

Other objectives, advantages and novel features of the invention will become more apparent from the following detailed description when taken in conjunction with the accompanying drawings.

DETAILED DESCRIPTION OF THE INVENTION

Figure 1:
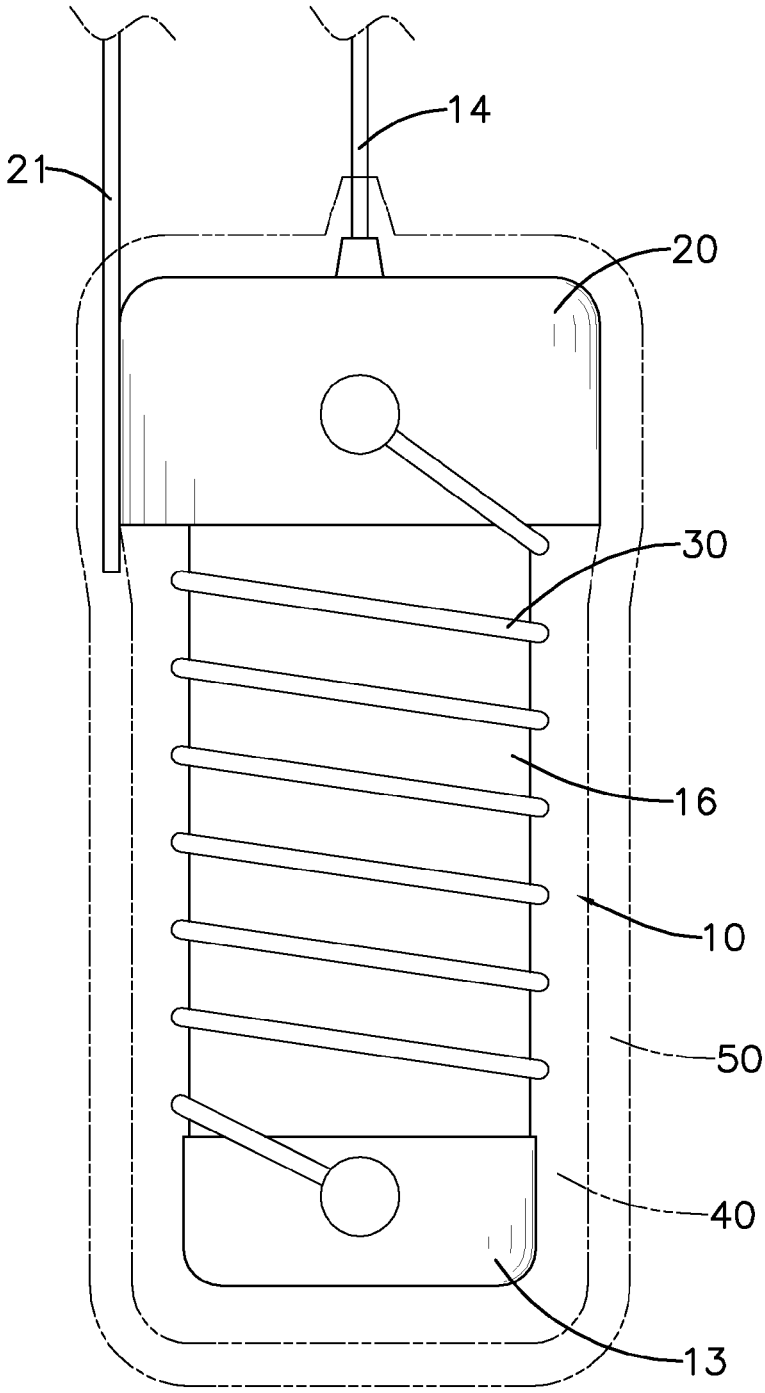
FIG. 1 is a top view of a first embodiment of an overcurrent protective wire wound resistor in accordance with the present invention.
Figure 2:
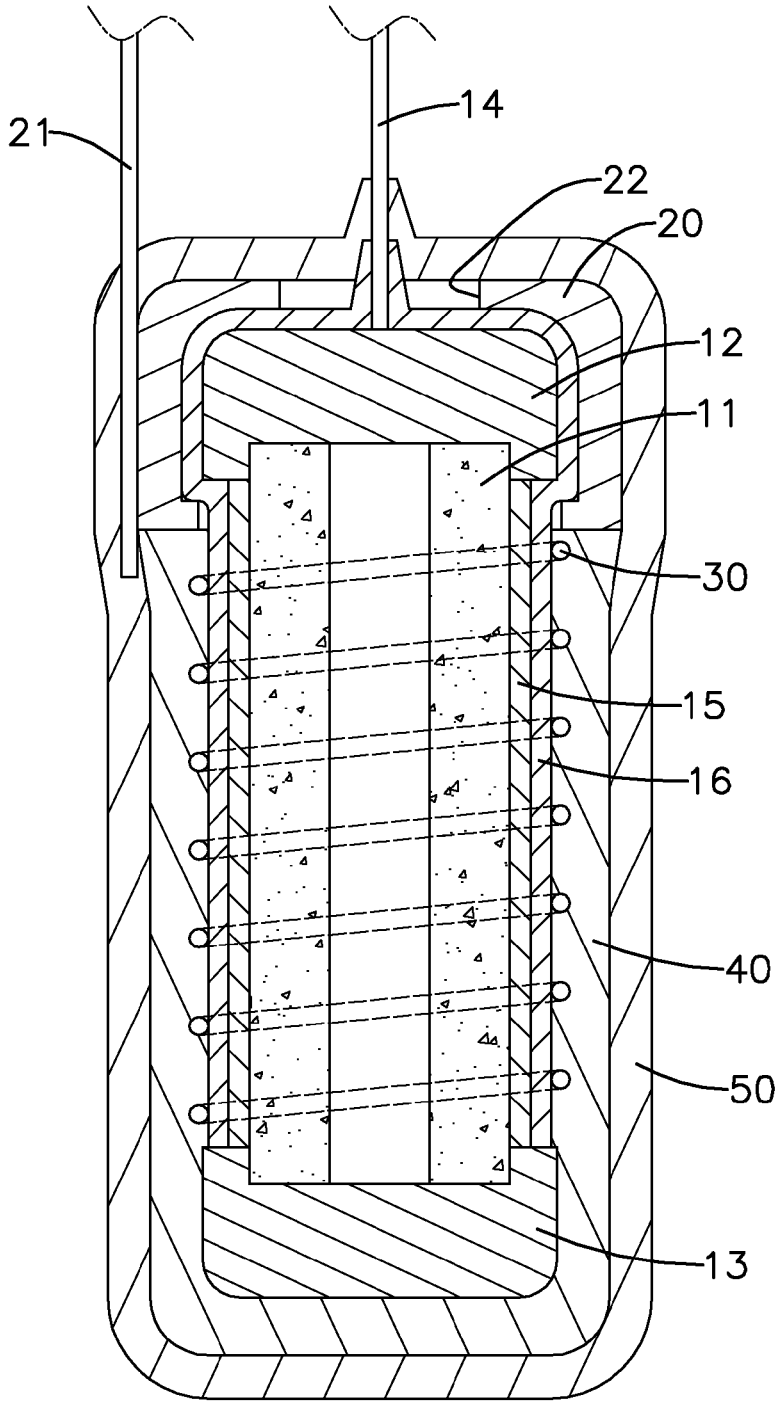
FIG. 2 is a top view in partial section of a second embodiment of an overcurrent protective wire wound resistor in accordance with the present invention.

With reference to FIGS. 1 and 2, an overcurrent protective wire wound resistor in accordance with the present invention has a high-temperature opening core 10, a second contact cap 20 and a resistance wire 30.

Figure 3:
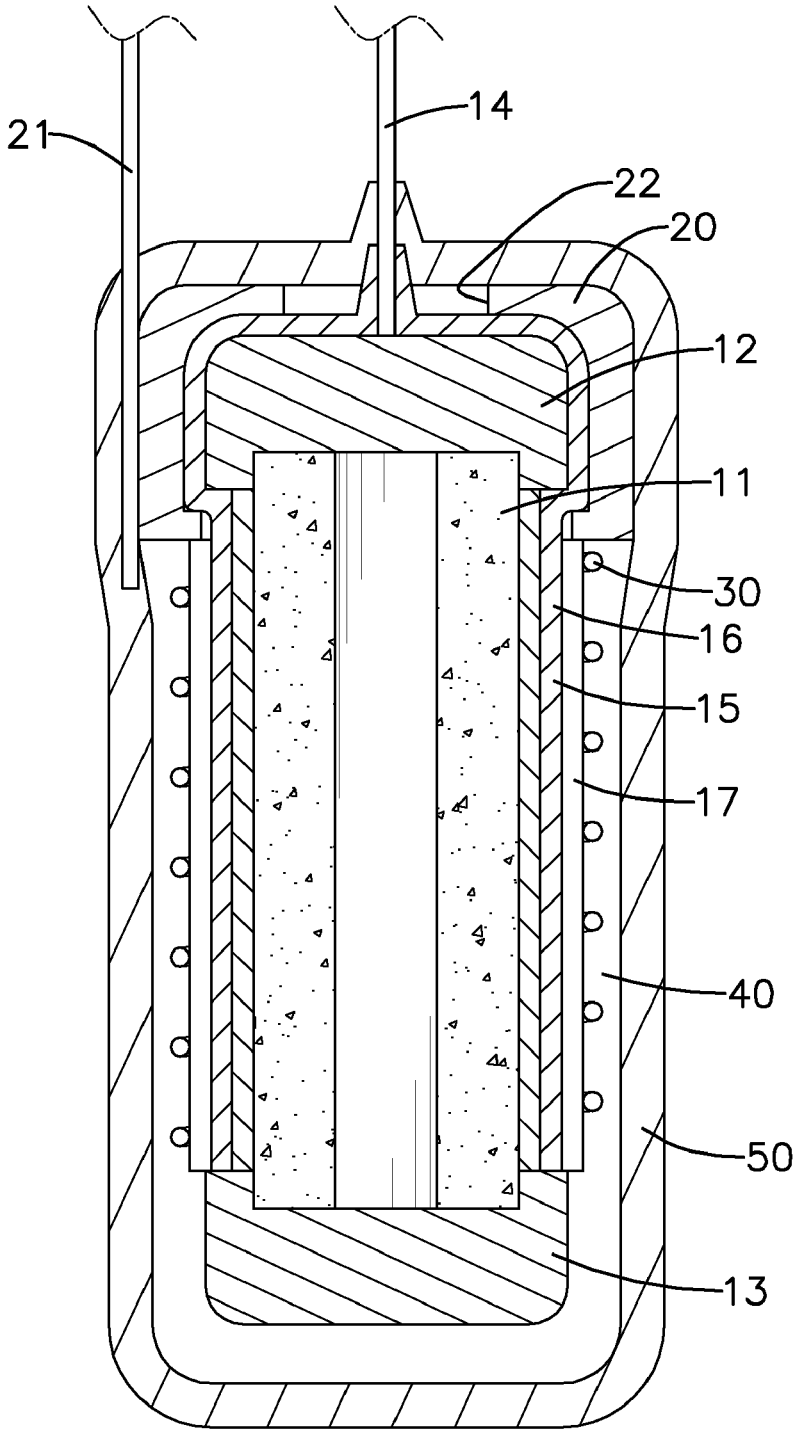
FIG. 3 is a top view in partial section of a third embodiment of an overcurrent protective wire wound resistor in accordance with the present invention.

The high-temperature opening core 10 has a rod 11, a first contact cap 12, a resistor connection seat 13, a low melting point conductive layer 15 and a high-temperature contractive insulation layer 16. The rod 11 has two opposite ends. The first contact cap 12 has a first lead wire 14 mounted thereon and two opposite ends. The first contact cap 12 and the resistor connection seat 13 are respectively mounted on the two opposite ends of the rod 11. The first lead wire 14 and the rod 11 are respectively mounted on the two opposite ends of the first contact cap 12. The low melting point conductive layer 15 is mounted around a periphery of the rod 11 and extends longitudinally to the first contact cap 12 and the resistor connection seat 13. The high-temperature contractive insulation layer 16 is mounted around the low melting point conductive layer 15, the first contact cap 12 and an end of the first lead wire 14 connected with the first contact cap 12. The melting point of the low melting point conductive layer 15 is lower than that of the high-temperature contractive insulation layer 16. In the present embodiment, the high-temperature contractive insulation layer 16 is fully sheathed around the low melting point conductive layer 15, the first contact cap 12 and an end of the first lead wire 14 connected with the first contact cap 12. With reference to FIG. 3, The high-temperature opening core 10 further has a heat-conductive insulation layer 17 mounted around the high-temperature contractive insulation layer 16, and may be a ceramic tube or a heat-conductive paint.

The second contact cap 20 corresponds to the first contact cap 12 of the high-temperature opening core 10 and is mounted around the high-temperature contractive insulation layer 16 so that the high-temperature contractive insulation layer 16 is sandwiched between the second contact cap 20 and the first contact cap 12 and the second contact cap 20 is electrically insulated from the first contact cap 12. The second contact cap 20 has a second lead wire 21 and a through hole 22. The second lead wire 21 is mounted on the second contact cap 20. The through hole 22 is formed through the second contact cap 20 to correspond to the first lead wire 14 for the first lead wire 14 to penetrate through the through hole 22.

The resistance wire 30 is mounted around the rod 11 of the high-temperature opening core 10 to correspond to the rod 11 and is electrically insulated from the low melting point conductive layer 15 by the intervening high-temperature contractive insulation layer 16 therebetween. Two ends of the resistance wire 30 are respectively connected to the resistor connection seat 13 and the second contact cap 20. The melting point of the resistance wire 30 is higher than that of the low melting point conductive layer 15. In the present embodiment, the resistance wire 30 is wound around a periphery of the high-temperature contractive insulation layer 16. With reference to FIG. 3, the resistance wire 30 is wound around a periphery of the heat-conductive insulation layer 17. Two ends of the resistance wire 30 are respectively soldered on the resistor connection seat 13 and the second contact cap 20.

The wire wound resistor further has a first protection layer 40 and a second protection layer 50. The first protection layer 40 is mounted around the resistor connection seat 13 of the high-temperature opening core 10 and a portion of the high-temperature contractive insulation layer 16 not covered by the second contact cap 20. With reference to FIG. 3, the first protection layer 40 is mounted around the resistor connection seat 13 and the heat-conductive insulation layer 17. The second protection layer 50 is fully mounted around the first protection layer 40, the second contact cap 20 and a portion of the second lead wire 21 connected with the second contact cap 20.

Figure 4:
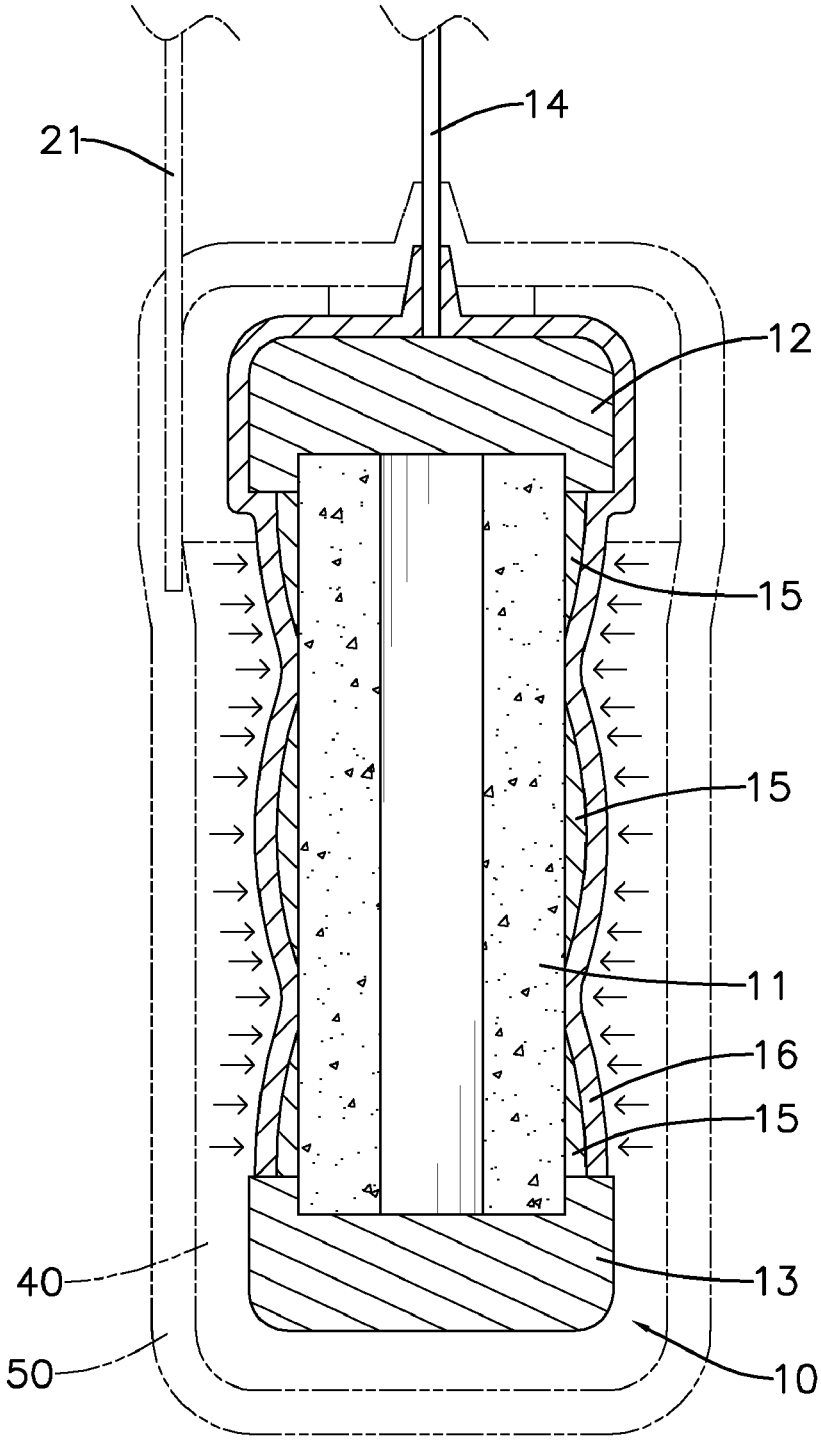
FIG. 4 is an operational top view in partial section of the overcurrent protective wire wound resistor in FIG. 2.
Figure 5:
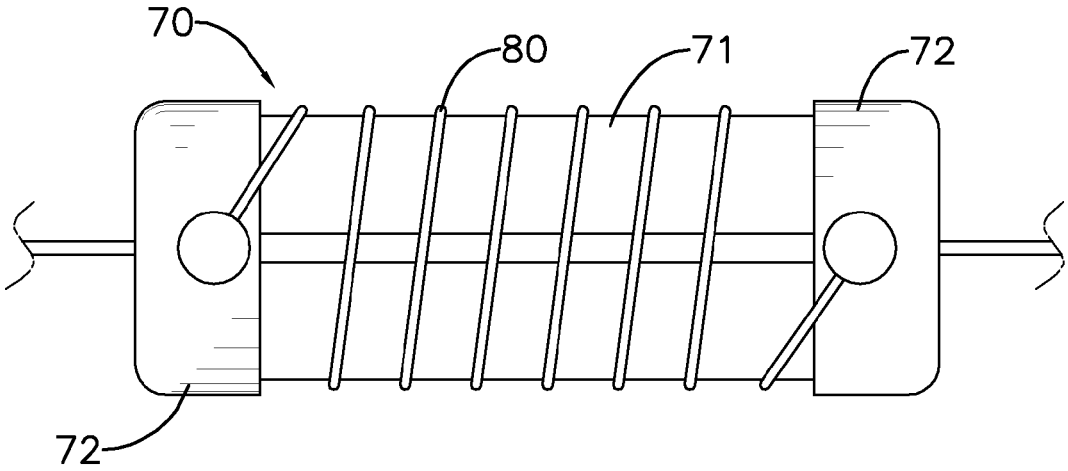
FIG. 5 PRIOR ART
FIG. 5 is a side view of a conventional wire wound resistor.

The first lead wire 14 of the wire wound resistor is electrically connected to the second lead wire 21 sequentially through the first contact cap 12, the low melting point conductive layer 15, the resistor connection seat 13, the resistance wire 30 and the second contact cap 20. When the first lead wire 14 and the second lead wire 21 are soldered to a circuit board, if current flowing through the resistance wire 30 abnormally increases, temperature of the resistance wire 30 rises. When the temperature of the resistance wire 30 rises to the melting point of the low melting point conductive layer 15, the low melting point conductive layer 15 starts melting and the high-temperature contractive insulation layer 16 is contracted by the high temperature of the resistance wire 30 so that the contracted high-temperature contractive insulation layer 16 pushes through the melted liquid low melting point conductive layer 15 to be closely attached around the periphery of the rod 11. With reference to FIG. 4, a portion of the low melting point conductive layer 15 adjacent to the first contact cap 12 is electrically insulated from a portion of the low melting point conductive layer 15 adjacent to the resistor connection seat 13 by the high-temperature contractive insulation layer 16 attached around the rod 11 so that the first contact cap 12 is electrically insulated from the resistance wire 30 and the wire wound resistor is opened to address an overcurrent protection and protect circuit connected to the wire wound resistor from being damaged.

When the current of the wire wound resistor abnormally increases, the low melting point conductive layer connected with the first contact cap and the resistor connection seat melts. The high-temperature contractive insulation layer is simultaneously contracted to block the first contact cap and the resistor connection seat and make them electrically insulated from each other so that an open circuit is generated between the first lead wire and the second lead wire of the wire wound resistor. Accordingly, the wire wound resistor of the present invention can protect circuit connected thereto without the use of a fuse.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An overcurrent protective wire wound resistor comprising:

a high-temperature opening core having:

a rod having two opposite ends;

a first contact cap mounted on one of the opposite ends of the rod and having:

two opposite ends; and a first lead wire mounted thereon, wherein the first lead wire and the rod are respectively mounted on the two opposite ends of the first contact cap;

a resistor connection seat mounted on the other of the opposite ends of the rod;

a low melting point conductive layer mounted around a periphery of the rod and extending longitudinally to the first contact cap and the resistor connection seat;

a high-temperature contractive insulation layer mounted around the low melting point conductive layer, the first contact cap and an end of the first lead wire connected with the first contact cap, wherein a melting point of the low melting point conductive layer is lower than that of the high-temperature contractive insulation layer;

a second contact cap corresponding to the first contact cap of the high-temperature opening core and mounted around the high-temperature contractive insulation layer so that the high-temperature contractive insulation layer is sandwiched between the second contact cap and the first contact cap and the second contact cap is electrically insulated from the first contact cap, and having:

a second lead wire mounted on the second contact cap; and a through hole formed through the second contact cap to correspond to the first lead wire for the first lead wire to penetrate through the through hole; and a resistance wire mounted around the rod to correspond to the rod and electrically insulated from the low melting point conductive layer by the intervening high-temperature contractive insulation layer therebetween, wherein two ends of the resistance wire are respectively connected to the resistor connection seat and the second contact cap, and a melting point of the resistance wire is higher than that of the low melting point conductive layer.

2. The overcurrent protective wire wound resistor as claimed in claim 1, wherein the high-temperature contractive insulation layer is fully sheathed around the low melting point conductive layer, the first contact cap and an end of the first lead wire connected with the first contact cap.

3. The overcurrent protective wire wound resistor as claimed in claim 1, wherein the resistance wire is wound around a periphery of the high-temperature contractive insulation layer.

4. The overcurrent protective wire wound resistor as claimed in claim 2, wherein the resistance wire is wound around a periphery of the high-temperature contractive insulation layer.

5. The overcurrent protective wire wound resistor as claimed in claim 1, further comprising a heat-conductive insulation layer mounted around the high-temperature contractive insulation layer, wherein the resistance wire is wound around a periphery of the heat-conductive insulation layer.

6. The overcurrent protective wire wound resistor as claimed in claim 2, further comprising a heat-conductive insulation layer mounted around the high-temperature contractive insulation layer, wherein the resistance wire is wound around a periphery of the heat-conductive insulation layer.

7. The overcurrent protective wire wound resistor as claimed in claim 5, wherein the heat-conductive insulation layer is a ceramic tube or heat-conductive paint.

8. The overcurrent protective wire wound resistor as claimed in claim 6, wherein the heat-conductive insulation layer is a ceramic tube or heat-conductive paint.

9. The overcurrent protective wire wound resistor as claimed in claim 1, wherein two ends of the resistance wire are respectively soldered on the resistor connection seat and the second contact cap.

10. The overcurrent protective wire wound resistor as claimed in claim 2, wherein two ends of the resistance wire are respectively soldered on the resistor connection seat and the second contact cap.

11. The overcurrent protective wire wound resistor as claimed in claim 3, wherein two ends of the resistance wire are respectively soldered on the resistor connection seat and the second contact cap.

12. The overcurrent protective wire wound resistor as claimed in claim 4, wherein two ends of the resistance wire are respectively soldered on the resistor connection seat and the second contact cap.

13. The overcurrent protective wire wound resistor as claimed in claim 7, wherein two ends of the resistance wire are respectively soldered on the resistor connection seat and the second contact cap.

14. The overcurrent protective wire wound resistor as claimed in claim 8, wherein two ends of the resistance wire are respectively soldered on the resistor connection seat and the second contact cap.

15. The overcurrent protective wire wound resistor as claimed in claim 3, further comprising a first protection layer mounted around the resistor connection seat and a portion of the high-temperature contractive insulation layer not covered by the second contact cap.

16. The overcurrent protective wire wound resistor as claimed in claim 4, further comprising a first protection layer mounted around the resistor connection seat and a portion of the high-temperature contractive insulation layer not covered by the second contact cap.

17. The overcurrent protective wire wound resistor as claimed in claim 11, further comprising a first protection layer mounted around the resistor connection seat and a portion of the high-temperature contractive insulation layer not covered by the second contact cap.

18. The overcurrent protective wire wound resistor as claimed in claim 12, further comprising a first protection layer mounted around the resistor connection seat and a portion of the high-temperature contractive insulation layer not covered by the second contact cap.

19. The overcurrent protective wire wound resistor as claimed in claim 15, further comprising a second protection layer fully mounted around the first protection layer, the second contact cap and a portion of the second lead wire connected with the second contact cap.

20. The overcurrent protective wire wound resistor as claimed in claim 16, further comprising a second protection layer fully mounted around the first protection layer, the second contact cap and a portion of the second lead wire connected with the second contact cap.

* * * * *